US008638643B1

(12) United States Patent
Al Hashash

(10) Patent No.: US 8,638,643 B1
(45) Date of Patent: Jan. 28, 2014

(54) GLOBE-SHAPED CLOCK FOR CITY SQUARE

(71) Applicant: Ahmad A. A. Kh. Al Hashash, Rabiya (KW)

(72) Inventor: Ahmad A. A. Kh. Al Hashash, Rabiya (KW)

( * ) Notice: Subject to any disclaimer, the term of this patent is extended or adjusted under 35 U.S.C. 154(b) by 0 days.

(21) Appl. No.: 13/951,389

(22) Filed: Jul. 25, 2013

(51) Int. Cl.
*G04B 19/22* (2006.01)

(52) U.S. Cl.
USPC ..... 368/23; 368/24; 434/142

(58) Field of Classification Search
USPC ..... 368/21, 23, 24; 434/142, 149
See application file for complete search history.

(56) References Cited

U.S. PATENT DOCUMENTS

| | | | | | |
|---|---|---|---|---|---|
| 500,659 | A | * | 7/1893 | Jourdan | 368/24 |
| 1,079,796 | A | * | 11/1913 | Nordling | 368/23 |
| 1,178,922 | A | * | 4/1916 | Jacquemoud | 368/136 |
| 2,253,747 | A | | 8/1941 | Alland | |
| 2,434,250 | A | | 1/1948 | Rebus | |
| D185,370 | S | | 6/1959 | Kinosian | |
| 3,049,863 | A | | 8/1962 | Ranney | |
| 3,823,548 | A | * | 7/1974 | Riba | 368/21 |
| 3,983,688 | A | | 10/1976 | Kockinos | |
| 4,477,193 | A | | 10/1984 | Yasufuku | |
| 4,671,672 | A | | 6/1987 | Hübner | |
| D309,718 | S | | 8/1990 | Fotovat | |
| 5,008,867 | A | * | 4/1991 | Ko | 368/23 |
| 5,379,271 | A | * | 1/1995 | Moedt | 368/24 |
| D419,456 | S | | 1/2000 | Ho | |
| 2002/0131329 | A1 | * | 9/2002 | Ochoa Loaiza | 368/23 |

* cited by examiner

*Primary Examiner* — Vit W Miska
(74) *Attorney, Agent, or Firm* — Richard C. Litman

(57) ABSTRACT

The globe-shaped clock for a city square includes a base for placement on a select public location in a town or city. The base includes a plurality of pointer rods radiating in both major and minor geographic directions. A spherical cage is mounted to the base, and the cage surrounds a rotating globe therein. The cage is topped by a clock spire having a frusto-conical base and a plurality of major and minor pointer rods radiating towards both major and minor geographic directions. A plurality of illuminated, curved, longitude lines defines the spherical cage. The longitude lines illuminate sequentially in varying intensity depending on the time of day. An electronic control unit is provided to define the pattern of illumination. A plurality of display units surrounds the base in line with each longitude line and displays different time zones.

15 Claims, 5 Drawing Sheets

GLOBE-SHAPED CLOCK FOR CITY SQUARE

BACKGROUND OF THE INVENTION

1. Field of the Invention

The present invention relates to landmark devices, and particularly to a globe-shaped clock for city square providing a conspicuous, memorable and utilitarian architectural feature in a public setting.

2. Description of the Related Art

Many cities, towns and other residential communities around the world boast some sort of architectural or artistic structure of note indigenous with the particular locale. These all serve as a landmark, oftentimes as a point of historical or cultural significance.

Some are very famous, such as the vigilant Big Ben watch tower in London, England; the beautiful Trevi Fountain in Rome, Italy; the majestic Statue of Liberty in New York, U.S.A.; and the grand Abraj Al Bait Towers in Riyadh, Saudi Arabia. Others may not have the same widespread popularity, but they still hold similar familiarity for the surrounding community. Some of these examples include statues of local heroes or sculptures depicting local historical events. No matter the extent of popularity, all the above serve as a focal point for congregations and navigation around the town or city. They also serve as an attraction for tourism, and are sometimes a substantial factor to any local economy.

While these types of structures provide their own unique appeal for the region, none appear to provide a more modern, understated, memorable, and utilitarian impact that would be accessible to a wider range of venues and audiences. For example, most of the above mentioned landmarks have existed for a relatively long time. However, they may not garner the same appeal or veneration with the younger generations whose tastes may run counter to the older ones. Additionally, the sensory overload of the flashy displays typical of various structures and landmarks in some locales, such as Las Vegas and Tokyo, may be more appealing to younger generations, but can be seemingly garish to the aesthetics of older generations. Often, these are short-lived, high-tech facades lacking substantial longevity, e.g., timeless architecture, artistic representation, unique and utilitarian feature(s), etc. Thus, a globe-shaped clock for a city square solving the aforementioned problems is desired.

SUMMARY OF THE INVENTION

The globe-shaped clock for a city square includes a base for placement on a select public location in a town or city. The base includes a plurality of pointer rods radiating in both major and minor geographic directions. A spherical cage is mounted to the base, and the cage surrounds a rotating globe therein. The cage is topped by a clock spire having a frustoconical base and a plurality of major and minor pointer rods radiating towards both major and minor geographic directions. A plurality of illuminated, curved, longitude lines defines the spherical cage. The longitude lines illuminate sequentially in varying intensity, depending on the time of day. A control is provided to define the pattern of illumination. A plurality of display units surrounds the base in line with each longitude line and displays different time zones.

These and other features of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
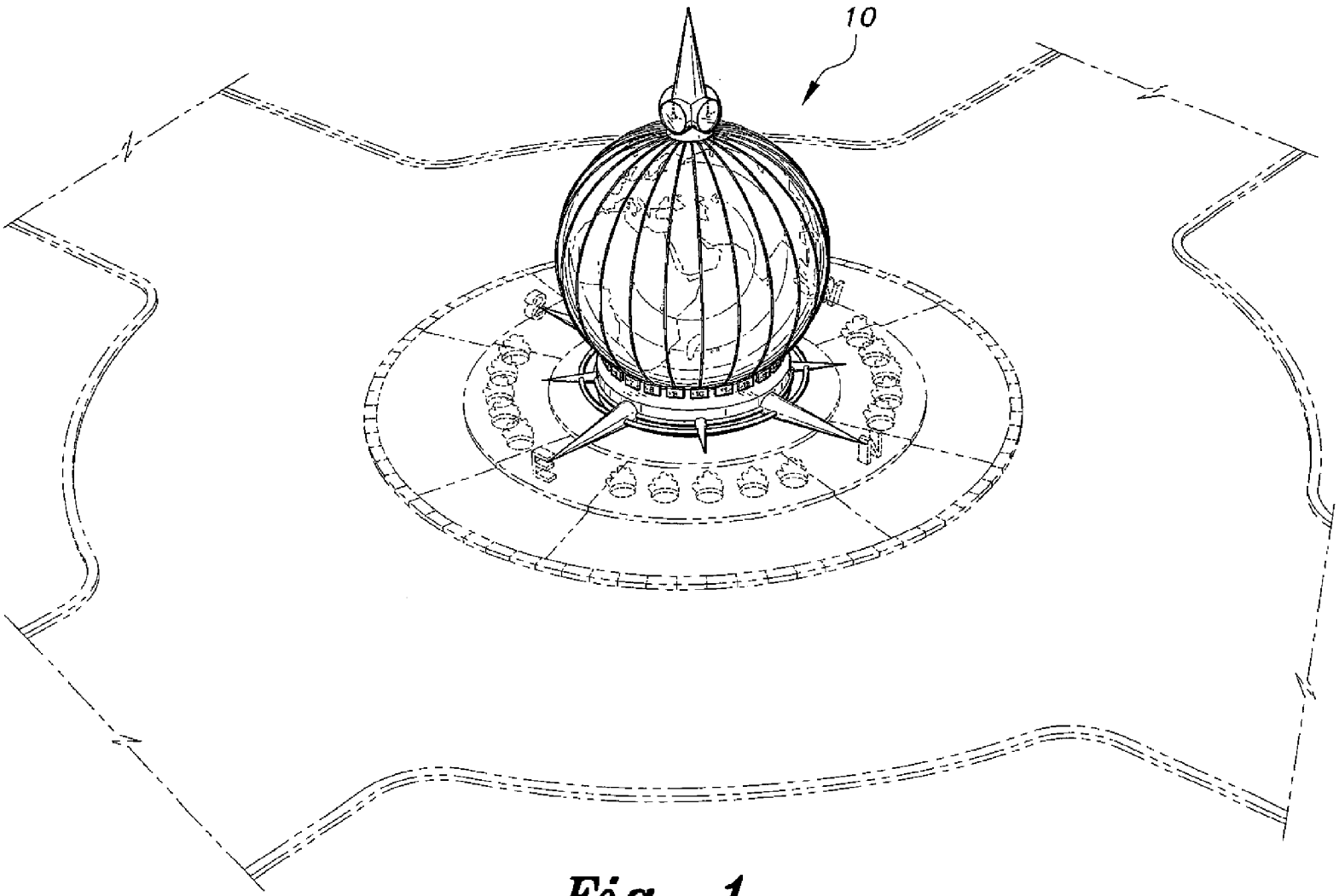
FIG. 1 is an environmental, perspective view of a globe-shaped clock for a city square according to the present invention.
Figure 2:
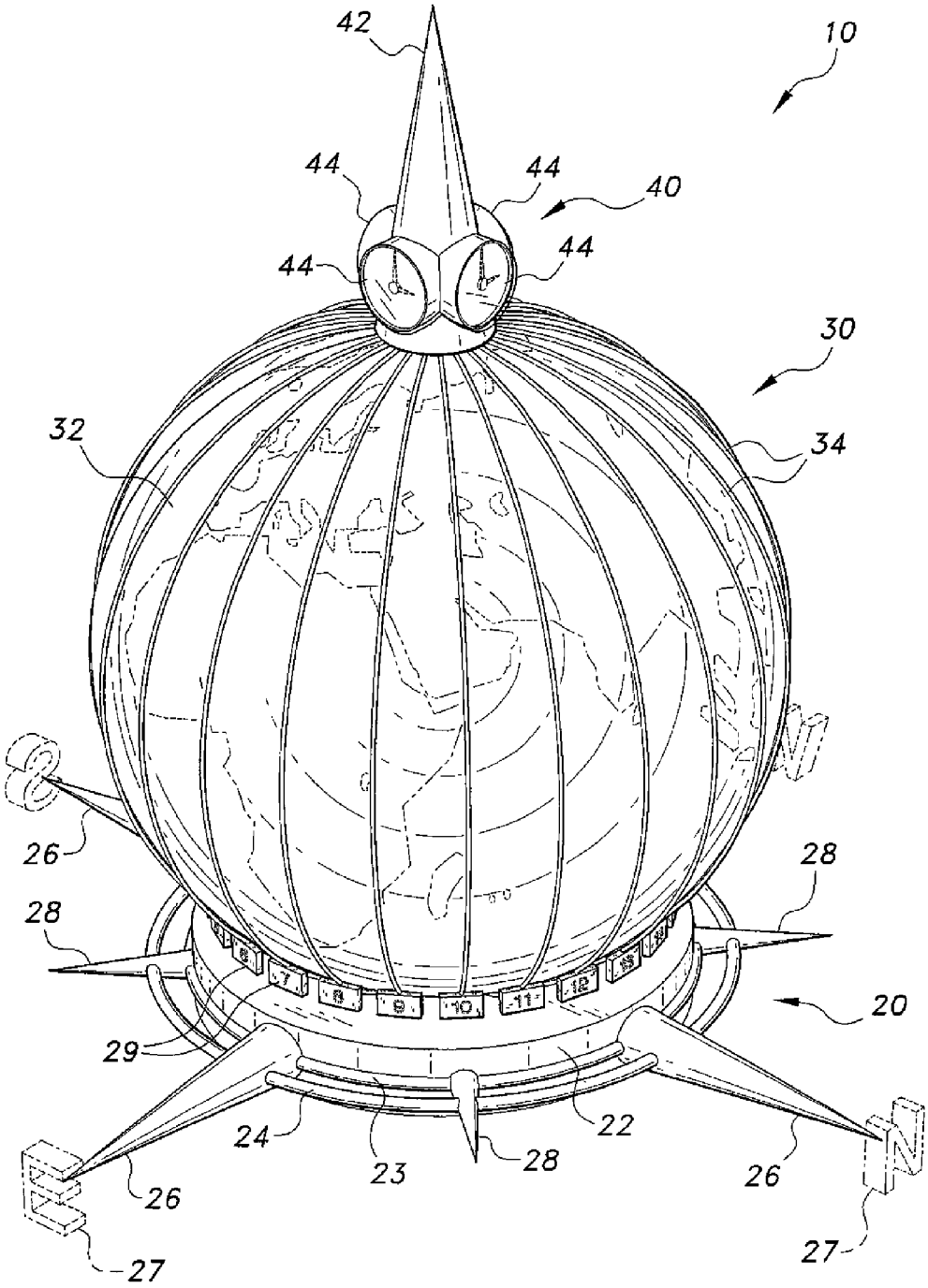
FIG. 2 is a perspective view of the globe-shaped clock of FIG. 1.
Figure 3:
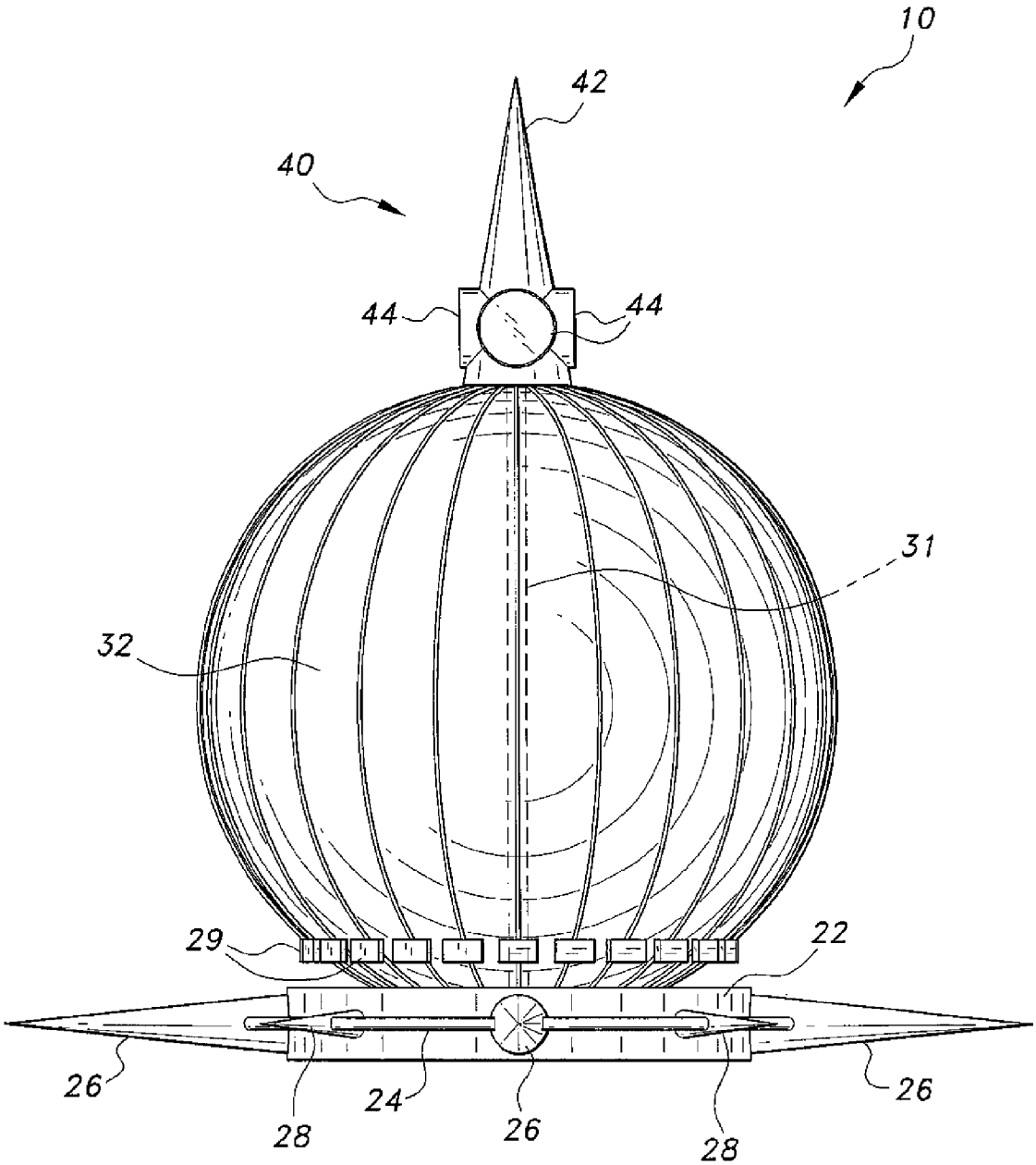
FIG. 3 is side view of the globe-shaped clock of FIG. 1.
Figure 4:
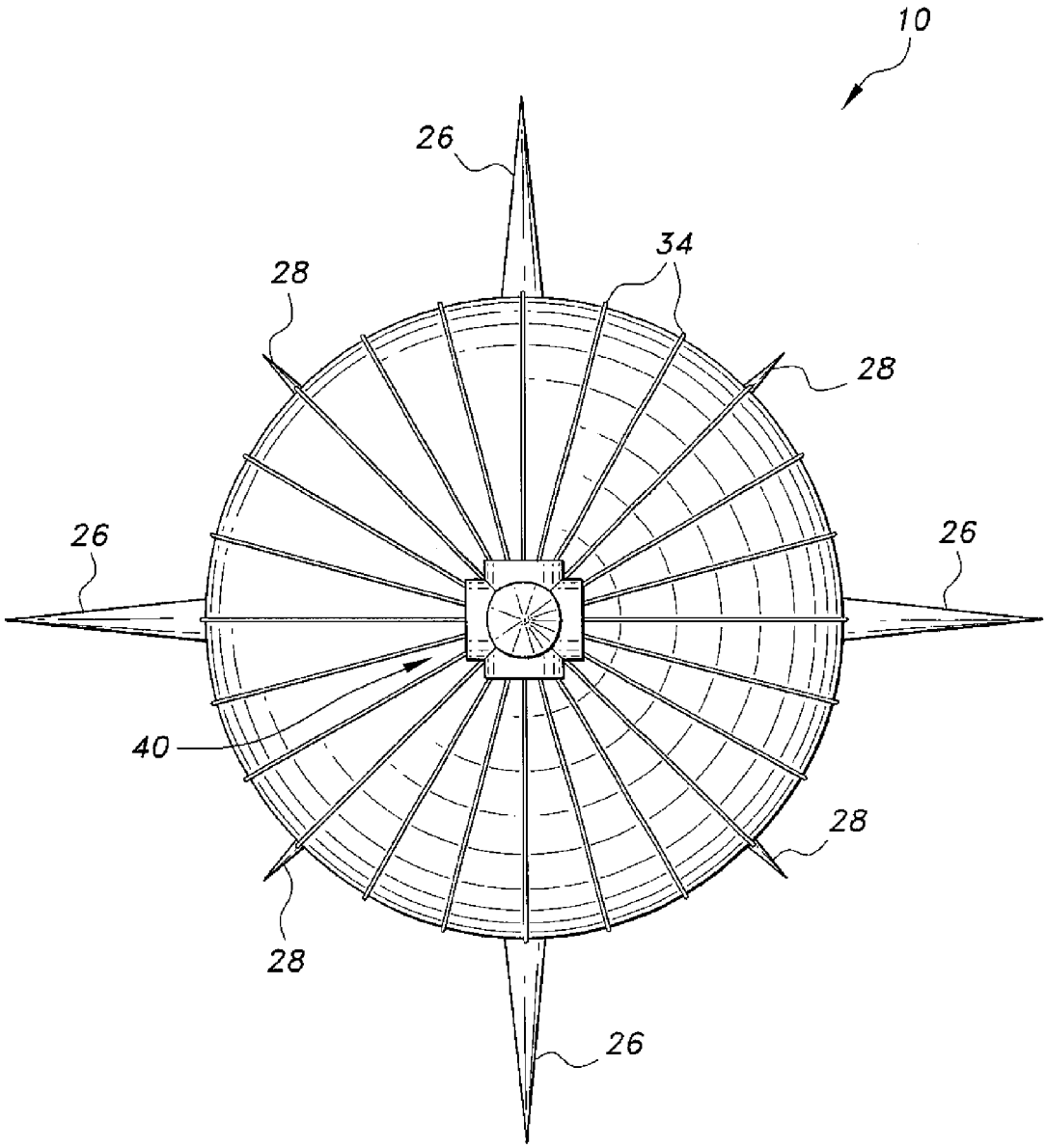
FIG. 4 is a top view of the globe-shaped clock of FIG. 1.

The globe-shaped clock for a city square, generally referred to by the reference number 10 in the drawings, provides an arresting, visually informative structure embodied in a timeless architectural monument appealing to a relatively wide audience. As shown in FIGS. 1-4, the globe-shaped clock 10 includes a base 20 supporting a spherical cage 30. A globe 32 is rotatably mounted inside the cage 30, and a clock spire 40 rests atop the cage 30.

The base 20 can be constructed as an architectural representation of a common compass. The base 20 includes a circular foundation 22 for securely supporting the other components thereon. It is preferable that the foundation 22 be placed in the middle of a town square, serving as a convenient focal point for local traffic and a meeting place. At least one ring, e.g., a first ring 23 and a second ring 24, surrounds the foundation 22, and a plurality of pointer rods, bars or beams 26, 28 radiate therefrom. The plurality of pointer rods 26, 28 can be divided into two groups, i.e., a plurality of major pointer rods 26 and a plurality of minor pointer rods 28. Each of the pointer rods 26, 28 can be constructed as elongate, frustoconical bars. When installed, the major pointer rods 26 preferably extend towards the major geographic points of a compass, i.e., North, South, East and West. The minor pointer rods 28 represent the points in between, such as Northwest, Northeast, Southeast, and Southwest. It is to be noted that the foundation 20, rings 23, 24, and/or the pointer rods 26, 28 can be provided in various shapes and sizes, as desired by the user. At least the major pointer rods 26 can also be provided with a letter at the distal end corresponding to the major geographical points.

The spherical cage 30 can be constructed from a plurality of curved, vertical longitude lines 34 that each have one end attached to the base 20 and the opposite end attached to the clock spire 40. Preferably, the spherical cage 30 is provided with twenty-four longitude lines 34 spaced at predetermined angular intervals about the axis of rotation of the globe 32. Each longitude line 34 represents a time zone at one hour intervals corresponding to the GMT standard. Each vertical line 34 is illuminated, preferably by a plurality of LEDs (light emitting diodes) mounted thereon, as further described below.

The clock spire 40 is mounted atop the spherical cage 30, providing an elevated vantage for viewing by any passerby. The clock spire 40 includes a tapering base or cap 42 having a plurality of clocks 44 radiating therefrom. Preferably, each clock 44 extends or faces the same direction as the corresponding major pointer rods 26. Each clock 44 can be constructed as conventional hand clocks, digital clocks, or any other similar clocks. The time displayed thereon corresponds to the local time. Alternatively, one or more of the clocks 44 can be configured to display another time zone.

The globe 32 inside the spherical cage 30 is configured to rotate about a vertical shaft 31 disposed between the clock spire 40 and the base 20. Preferably, the globe 32 includes a graphic representation of the earth and can incorporate longitudinal and latitude lines thereon. The globe 32 can be transparent or opaque, and has clear delineation of the continents. The globe 32 is configured to rotate one revolution per minute. However, other intervals can be programmed into the globe-shaped clock 10. Additionally, the base 20 includes a plurality of display units 29 arranged in a circular pattern around the spherical cage 30. Each display unit 29 is preferably disposed beneath each vertical line 34 and shows the time zone hour corresponding to each vertical line 34. The time zone hour can be a permanent indicium or a user-defined selective indicium, e.g., a digital display. Thus, at each set interval of rotation of the globe 32, one can determine the relative time in other areas of the world with respect to the local time zone. In the case of the display unit 29 incorporating a digital display or the like, the displayed time zone can change in response to the rotation of the globe 32, e.g., a readable number with an accompanying city code. As an alternative, each display unit 29 can be configured to display other information, such as news, current events, public messages, and the like.

In one preferred configuration, the plurality of longitude lines 34 change in luminous intensity, depending on the local time. For example, the luminosity of the longitude lines 34 follows the rising and setting of the sun during the course of the day. If the projected time for sunrise is at 8 AM local time, the longitude line 34 at the 8th hour display unit 29 would be near its dimmest. The greatest intensity may occur around noon time when the sun would be at its zenith. As the day progresses, the intensity of each longitude line 34 varies, simulating the progress of the sun. Thus, at any given point of local time, a range of longitude lines 34 will display a gradient of luminous intensity corresponding to the passing day.

The above feature of the longitude lines 34 includes many variations. For example, the luminosity can be reversed so that instead of dim to bright, the variance can be from bright to dim. Since the LEDs include the capability of both color and intensity, these can be configured to display a corresponding range of visuals. For example, the range of luminous longitude lines 34 can be uniform or more gradual, depending on the relative tilt of the earth with respect to the sun. At certain times of the year, the northern or southern hemisphere will be closer to the sun. To simulate the same throughout the seasons, certain northern or southern regions of the cage 30 can also be brighter, ultimately resulting in a sinusoidal pattern following the course of the sun during a year. Such patterns can also be displayed in varying colors. For example, cooler times of the day, i.e. early morning and throughout the evening, can be represented in blue, gradually turning to bright red, orange or yellow as the day increases in temperature. Other color patterns can be used, depending on the desires of the user. Additionally, the illumination of the longitude lines 34 and pattern thereof do not have to be constrained to the path of the sun. Instead, each line 34 can be illuminated using the local place as a point of reference on the rotating globe 32. Thus, as the globe 32 rotates, a corresponding longitude line 34 illuminates as the reference point crosses the line 34. Alternative patterns also include representations of the local weather, signs, pictures or any other media that can be replicated through LED patterns. The visual display from the longitude lines 34 increases public notice resulting in more memorable acclaim attributed to the specific town or city. As a further alternative, the cage 30 can also include selectively illuminated latitude lines.

Figure 5:
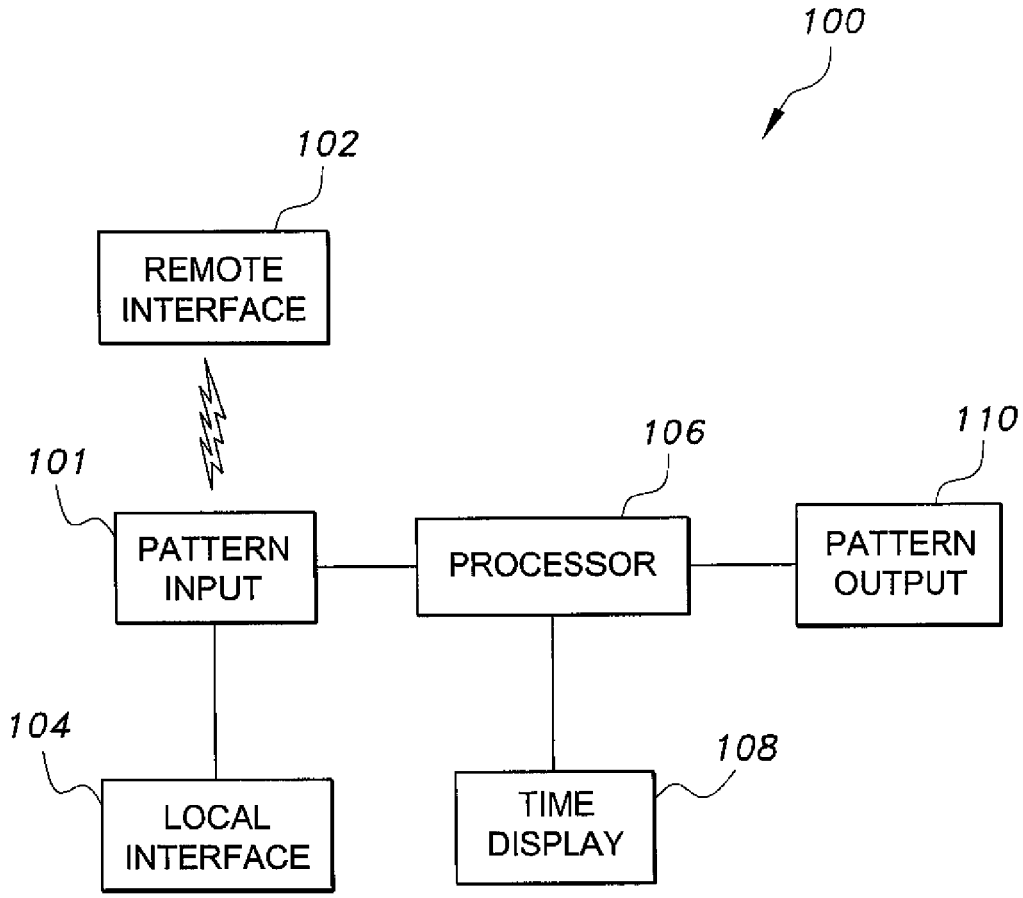
FIG. 5 is a block diagram of the control electronics for the globe-shaped clock of FIG. 1.

As best shown in FIG. 5, all the above can be accomplished via an electronic control unit 100. The control unit 100 includes a pattern input 101, which receives user-defined commands for the display patterns of the longitude lines 34. A user can input the commands either through remote access 102 or direct access 104. Remote access 102 can include such devices as tablets, cell phones, laptops, and the like, while direct access 104 can be a dedicated workstation or an onsite input module.

The input commands are processed through a central processor 106. The processor 106 converts the commands and controls the pattern output 110 for the longitude lines 34. Additionally, the central processor 106 also controls the time display 108 reflected in the clocks 44. The accuracy of the time can be verified or updated by manual periodic checks or by automatic means, such as synchronization with an atomic clock.

It is to be understood that the present invention is not limited to the embodiments described above, but encompasses any and all embodiments within the scope of the following claims.

I claim:

1. A globe-shaped clock for city square, comprising:

a base adapted to be installed on a support surface, the base having a plurality of pointer rods radiating therefrom;

a spherical cage mounted on the base, the cage having a plurality of curved, longitude lines defining the cage, each of the longitude lines being selectively illuminated;

a globe rotatably mounted inside the spherical cage;

a clock spire mounted to the top of the spherical cage, the clock spire having at least one clock disposed thereon;

a plurality of display units attached to the base, each display unit being in line with each longitude line; and an electronic control unit for programming a user-defined pattern of illumination for each of the longitude lines.

2. The globe-shaped clock for city square according to claim 1, wherein said base comprises a circular block.

3. The globe-shaped clock for city square according to claim 2, further comprising a group of major pointer rods and a group of minor pointer rods radiating from said circular block, each of the major pointer rods extending towards major geographic points of a compass, each of the minor pointer rods extending towards minor geographic points of the compass.

4. The globe-shaped clock for city square according to claim 3, wherein each said pointer rod comprises a frustoconical beam.

5. The globe-shaped clock for city square according to claim 3, wherein at least the major pointer rods include a direction indicator disposed at a distal end thereof.

6. The globe-shaped clock for city square according to claim 1, wherein each said longitude line comprises a plurality of LEDs having selectively actuating luminous intensity and color.

7. The globe-shaped clock for city square according to claim 6, wherein said plurality of longitude lines comprises twenty-four longitude lines, each said longitude line corresponding to a time zone.

8. The globe-shaped clock for city square according to claim 1, wherein said globe comprises a vertical shaft disposed between said base and said clock spire, said globe being rotatable about said vertical shaft at a given interval, said globe having a geographic representation of the earth.

9. The globe-shaped clock for city square according to claim 1, wherein said clock spire comprises a vertical, frustoconical base and a plurality of clocks disposed about the base, each of the clocks facing a major geographic direction.

10. The globe-shaped clock for city square according to claim 1, wherein each said display unit includes indicia disposed thereon, said indicia corresponding to a specific time zone.

11. A method of displaying time, comprising the steps of: providing a globe-shaped clock for city square, comprising:

a base adapted to be installed on a support surface, the base having a plurality of pointer rods radiating therefrom;

a spherical cage mounted on the base, the cage having a plurality of curved, longitude lines defining the cage, each of the longitude lines being selectively illuminated;

a globe rotatably mounted inside the spherical cage;

a clock spire mounted to the top of the spherical cage, the clock spire having at least one clock disposed thereon;

a plurality of display units attached to the base, each of the display units being in line with a corresponding one of the longitude lines; and an electronic control unit for programming a user-defined pattern of illumination for each of the longitude lines; and selectively illuminating the plurality of longitude lines in the user-defined pattern.

12. The method of displaying time according to claim 11, wherein said selectively illuminating step comprises the step of sequentially illuminating each longitude line at select time intervals.

13. The method of displaying time according to claim 12, wherein said step of selectively illuminating comprises the step of changing luminous intensity according to current time and phase of day.

14. The method of displaying time according to claim 12, wherein said step of selectively illuminating comprises the step of changing color according to current time and phase of day.

15. The method of displaying time according to claim 11, wherein said step of selectively illuminating comprises the step of displaying a color gradient in each line simulating the sun's position during a complete revolution of the earth.

* * * * *